United States Patent [19]

Monson et al.

[11] Patent Number: 4,788,738

[45] Date of Patent: Dec. 6, 1988

[54] COMPACT SELF-CONTAINED HAND HELD EXTRACTION CLEANER

[76] Inventors: Clifford L. Monson; Danny C. Perry; Theodor Domay, all of Honolulu; Henry A. Wilks, Kailua, all of Hi.

[21] Appl. No.: 817,509

[22] Filed: Jan. 9, 1986

Related U.S. Application Data

[63] Continuation-in-part of Ser. No. 755,796, Jul. 17, 1985.

[51] Int. Cl.[4] ..... A47L 5/24; A47L 7/00; A47L 9/18

[52] U.S. Cl. ..... 15/320; 15/344; 15/353

[58] Field of Search ..... 15/320, 344, 353, 321

[56] References Cited

U.S. PATENT DOCUMENTS

| | | | |
|---|---|---|---|
| 3,056,994 | 10/1962 | Noble | 15/321 |
| 3,117,337 | 1/1964 | Krammes | 15/353 X |
| 3,939,515 | 2/1976 | Platck | 15/321 |
| 4,156,952 | 6/1979 | Lynch, Jr. | 15/320 |
| 4,210,978 | 7/1980 | Johnson et al. | 15/320 |
| 4,536,914 | 8/1985 | Levine | 15/344 |
| 4,542,557 | 9/1985 | Levine | 15/344 |
| 4,549,329 | 10/1985 | St. Clair | 15/320 X |
| 4,566,149 | 1/1986 | Fitzwater | 15/353 X |
| 4,595,420 | 6/1986 | Williams, III et al. | 15/320 X |

*Primary Examiner*—Harvey C. Hornsby
*Assistant Examiner*—Scott J. Haugland
*Attorney, Agent, or Firm*—Sixbey, Friedman, Leedom & Ferguson

[57] ABSTRACT

A compact, self-contained cleaner and liquid extraction unit having a body member wherein a handle half of the body has all of the electrical components sealed therein, and cleaning fluid is retained within a removable discharge head half of the body that defines a plenum chamber and carries a spray nozzle and vacuum intake head. Arrangements are provided for preventing cleaning solution from being discharged through the vacuum intake head or flowing into the vacuum blower for the unit, and in some embodiments, a single unit operates to create a vacuum in the plenum chamber and to pump cleaning fluid to the spray nozzle.

12 Claims, 3 Drawing Sheets

2
3
4
6
7
8
8a
10
12
14
18
20
22
24
31
34c
36
37
39
52
56
58
60
64
66
68
70
72
74
76
78
80
82
84
86
88
90
92
94
96
98
A
V

COMPACT SELF-CONTAINED HAND HELD EXTRACTION CLEANER

This application is a continuation-in-part of our copending application Ser. No. 755,796 entitled COMPACT SELF-CONTAINED RECYCLING EXTRACTION CLEANER filed on Jul. 17, 1985.

TECHNICAL FIELD

The present invention relates generally to extraction cleaners and more specifically to a cleaning apparatus which is compact, lightweight, portable and completely self-contained.

BACKGROUND ART

Cleaning machines of the type wherein a washing liquid is fed from a receptacle to a surface to be washed and then, by means of suction, is returned to the original receptacle for further use, preferably after being filtered are known. For example, in Keefer U.S. Pat. No. 1,661,480, such a cleaning machine is disclosed wherein a tank-like receptacle is provided that houses the pump for dispensing the cleaning liquid, the suction fan for returning the liquid, and the filtering means, while also providing the storage facility for the cleaning liquid. The tank-like receptacle is designed to sit on the floor and flexible liquid discharge and liquid return hoses connect the tank-like receptacle with a cleaning head used to apply and retrieve the cleaning liquid from the surface being cleaned.

In Danielson et al U.S. Pat. No. 2,680,260, a form of cleaning machine is disclosed wherein a cleaning fluid is applied by the machine and is recollected through a filter back to a storage tank for recirculation. In the arrangement shown by of this patent, instead of a hose-connected cleaning head being utilized, as in the case of the Keefer patented unit, the underside of a wheeled tank-like receptacle (which houses the storage tank, pump and the like) has a cleaning liquid supplying conduit arranged to supply fluid centrally through a rotating brush that scrubs the surface to be cleaned. A circular mouthpiece surrounds the periphery of the brush and collects the liquid for return back up into the tank.

While devices of the aforementioned type are portable, they are anything but compact and lightweight, particularly when their cleaning fluid tank is full. Furthermore, the presence in such apparatus of a tank that must rest on the floor not only makes use of the apparatus cumbersome, but is restrictive with respect to the places that such a unit can be effectively utilized. For example, long flights of steps having no landing upon which the tank can rest can render the apparatus unusable. Furthermore, because of the cumbersome nature of such units, it is often impractical to utilize the unit for spot cleaning purposes, such as cleaning up a small spill, as opposed to general room cleaning.

As a result, it is desirable to have a cleaning apparatus wherein all of the operative components are mounted upon a common element so that the unit is unencumbered by a separate floor-supported tank. Lynch, Jr. U.S. Pat. No. 4,156,952, and Krammes U.S. Pat. Nos. 3,040,362 and ',986,764 show floor cleaning apparatus, configured similarly to an upright vacuum cleaner or so-called electric broom, that have all of the operative components for spraying a cleaning fluid onto a floor surface, such as a carpet, and for using suction to collect the dirty cleaning liquid, such as a means for storing the fluid that is applied and collected, mounted upon a common element. However, the versatility of such "common element" type cleaning apparatus is severely restricted to floor-type uses, because these units are too large and heavy to be used in a manner that is unsupported by contact with the floor surface to be cleaned and because the units are not designed for operation in orientations that would be necessary for cleaning vertical or inclined surfaces. Also, these units, while more compact and lightweight than the initially mentioned tank-type units, are not truly lightweight or compact either.

Attempts have been made to provide light weight, hand held cleaning units, but such units have not been capable of handling substantial amounts of cleaning fluid. Instead, these units are essentially vacuum cleaners which may be adapted to handle a limited amount of fluid present on a surface to be cleaned. They are not provided with cleaning fluid supply systems nor are they designed to exclude fluid from the operating portions of the unit. U.S. Pat. No. 4,536,914 to M. M. Levine illustrates a wet-dry vacuum cleaner of this type.

DISCLOSURE OF THE INVENTION

From the foregoing, it should be appreciated that there is a need for a cleaning apparatus that is relatively small, lightweight, easily portable, and versatile. It is, thus, a primary object of the present invention to achieve such a cleaning apparatus.

It is a further object of the present invention to construct a cleaning apparatus of the initially-mentioned type that is simple and easy to use.

Yet another object of the present invention is to enable a cleaning apparatus to be achieved that is amenable to portable, hand-held use and does not require floor support.

Still further, it is an object of the present invention to provide a cleaning apparatus of the aforementioned type that can be placed in various orientations, while loaded with cleaning solution, without damaging the apparatus or producing spillage.

These and other objects of the present invention are achieved in accordance with preferred embodiments by forming the apparatus of a body member wherein a handle half of the body has all of the electrical components sealed therein and the cleaning fluid is retained within a removable discharge head half of the body that defines a plenum chamber and carries a spray nozzle, and vacuum intake head. Furthermore, in accordance with another feature, solution conduits to and from a pump are built into the wall of the body in a manner that, when the cleaning fluid pump is located in the handle half, the conduit portions of the two halves sealingly mate in the assembled condition of the body halves. Still further, means are provided for preventing cleaning solution from becoming discharged through the vacuum head or flowing into the vacuum blower.

BEST MODE FOR CARRYING OUT THE INVENTION

Figure 1:
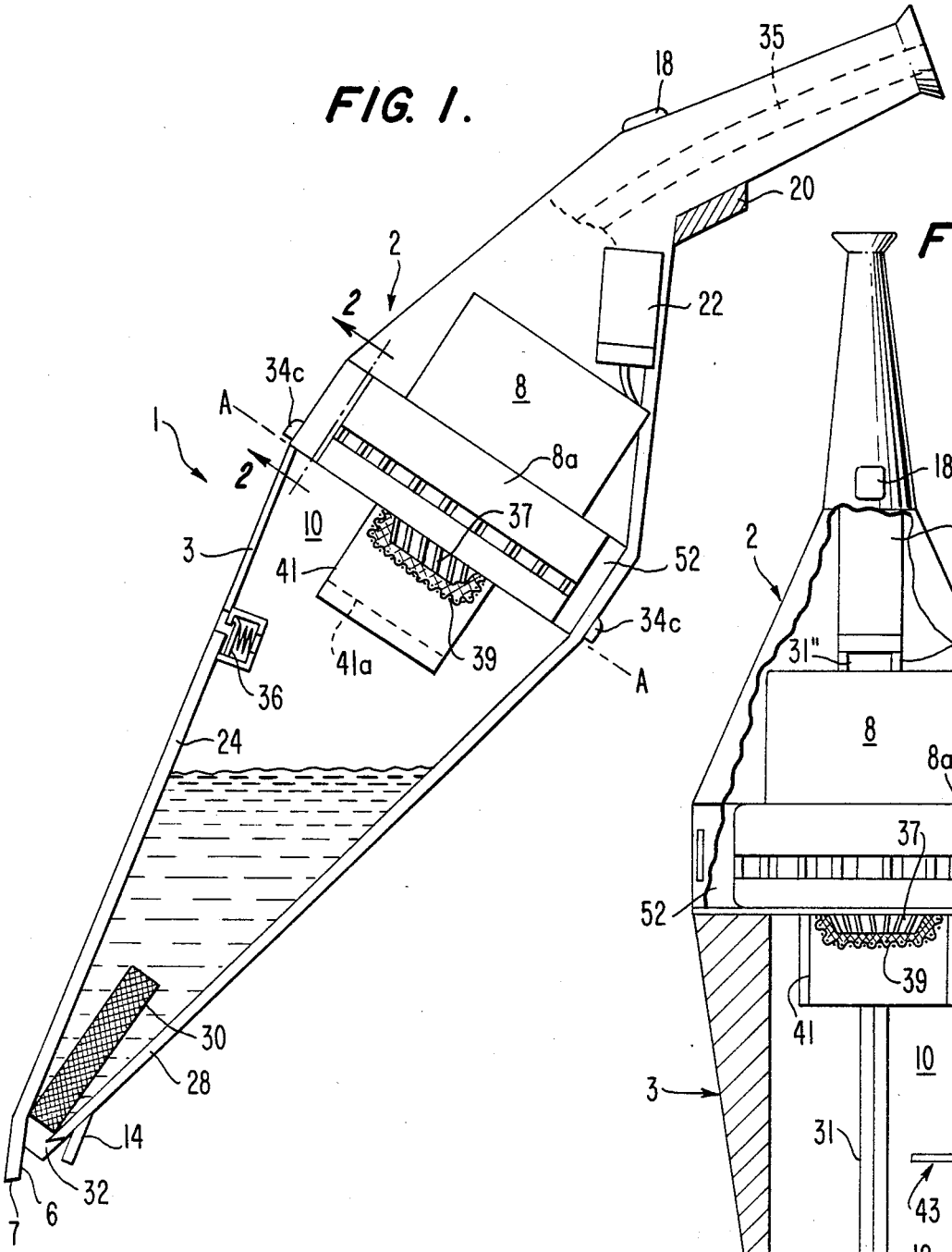
FIG. 1 is a diagrammatic partial longitudinal sectional view of the hand held extraction cleaner of the present invention.
Figure 2:
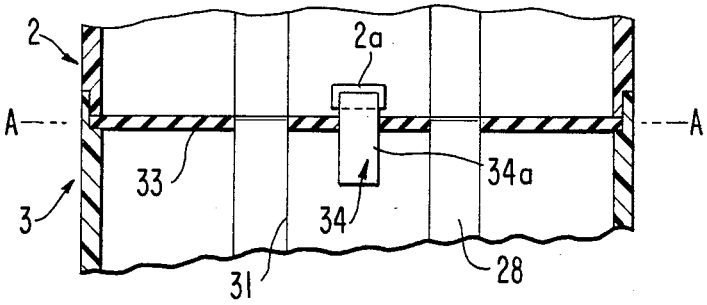
FIG. 2 is an enlarged sectional view taken along line 2—2 of FIG. 1.

With reference to the drawings, FIGS. 1 and 2 illustrate a first embodiment of a compact self-contained hand held extraction cleaner in accordance with the present invention wherein the reference numeral 1 designates the cleaner unit as a whole. The unit 1 is similar in size and configuration to the conventional hand held vacuum cleaners which are widely marketed and well known to the consuming public.

The cleaner unit 1 is formed of two main body components; namely, an upper, handle section 2 and a lower, discharge head section 3 that are joined together at respective, matingly engageable ends, along line A—A (FIG. 2). Opposite the mating ends, the upper section 2 terminates in a handle 4, while the lower section 3 terminates in a vacuum head 6 having a downward facing intake opening 7. The two sections 2 and 3 can be held together in any conventional manner that assures a leakproof seal at the junction A—A; although, one advantageous form of such an arrangement is described in greater detail in conjunction with FIG. 2.

It should be appreciated that the cleaning unit 1, in accordance with the present invention, utilizes a pump system for applying a spray of cleaning fluid to the surface to be cleaned and a vacuum extraction system to recover the applied cleaning fluid and dirt entrained therewith. To this end, a vacuum motor 8 (disposed at the lower end of the handle section 2) defines the upper end of a hollow plenum chamber 10 formed within the lower section 3 of the extraction cleaner unit 1. The plenum chamber 10 is, itself, essentially an extension of a hollow cleaning fluid receptacle 12.

A spray of cleaning fluid is applied via a spray nozzle 14 when power is supplied through a pump switch 20 to actuate a self-priming pump 22, shown mounted to an inner wall of the upper section 3 of the cleaner unit 1. In particular, the pump 22 draws cleaning solution from the receptacle 12, through filter 30, and up conduit 28 to the pump, after which it is delivered, under pressure, through a spray conduit 31 to the spray nozzle 14. In this regard, the conduits 28 and 31 are a molded or otherwise built-in portion of the wall of discharge head section 3 of the unit 1. The filter 30 prevents any solid matter that has been extracted, along with the cleaning fluid, into the receptacle 12 from being drawn up into the pump 22, which could lead to the pump becoming damaged or nozzle 12 or conduits 28 and 31 becoming clogged.

In order to enable the applied cleaning fluid to be extracted by the vacuum motor 8, via the intake opening 7 of the vacuum head 6 upon actuation of the vacuum switch 20, opening 7 communicates with the top of receptacle 12 (that communicates with the intake side of the vacuum motor 8 via the hollow plenum chamber 10) via a conduit 24 and vacuum valve 36. Conduit 34 is also preferably built into the wall of lower section 3, such as by being molded with portions of a plastic lower body section 3. Thus the vacuum head 6 is formed as an extension of a built-in conduit 24 which extends to the valve 36, which is a vacuum responsive valve. The cleaning solution filter 30 is mounted at the intake opening to an intake chamber 32 that communicates with the built-in conduit 28 leading to the pump 22, and the spray nozzle 14 is an externally projecting extension of the built-in delivery conduit 31.

All of the electrical components of the cleaner unit 1, including the pump 22, are located in the handle 2. Accordingly, the conduits 28 and 31 to and from the pump 22, also have portions built into the wall of the handle section 2.

In order to insure proper alignment of the two body sections 2 and 3, a leakproof junction is formed therebetween as shown in FIG. 2. In particular, the two sections 2, 3 are provided with stepped mating surfaces. For example, as shown, upper section 2, is stepped so that an exterior, circumferential recessed groove is provided, while lower section 3 is stepped in a reverse manner so that the circumferential recessed groove is formed internally. Moreover, the height of the interior recessed groove should be greater than the height of the exterior recessed groove by an amount corresponding to an extent that will result in a circumferentially extending interior clearance space being created within which a gasket seal 33 will be firmly gripped when the two sections are fully pushed together.

In order to hold the two sections 2 and 3 in a manner resulting in the compression of the gasket seal 33, a pair of latch members 34 are provided on, for example, the lower section 3 which will automatically latch into corresponding openings 2*a* of the upper section 2. For this purpose, the latch members 34 have a band-spring-like longitudinal extending body 34*a* to which a cam portion 34*c* radially outwardly projects. Thus, to separate the sections, the cam projections 34*c* need only be pressed inwardly until they disengage from the apertures 2*a*, whereupon the expansion force of the gasket seal 33 will produce a separation of the two sections to an extent preventing cam portions 34*c* from reengaging within the apertures 2*a*.

On the other hand, for resecuring the sections 2 and 3 together, the tongue and groove latching structures on the two sections need only be recoupled, the rounded upper surface of cam projection 34*c* enabling the latch members 34 to deflect to a non-interfering position. Thereafter, the two sections need only be pressed firmly together to an extent sufficient to slightly compress gasket seal 33, whereupon the cam portion 34*c* will be brought into alignment with the aperture 2*a* and the return force of the spring portion 34*a* will cause the cam portion 34*c* to move outwardly into the aperture 2*a*, relocking the sections together with a leak proof juncture formed therebetween. The combination of this junction and the built in conduits eliminates the problem of dangling hoses or hose connections which must be plugged and unplugged for separation of the two sections 2, 3. Of course, it should be recognized that this form of juncture between the sections of the unit can be modified to incorporate other known structures for sealing the two sections against fluid leakage.

Inasmuch as the pump 22 and vacuum motor 8 are enclosed within the smaller handle section 2, depending on the size of the motor and the heat produced thereby, it may be necessary to provide venting for the interior of the handle section. One such means is illustrated in FIG. 1, wherein a vent passage 35 is shown (in broken lines) extending through the handle 4. However, other convenient venting arrangements may be utilized to cool the pump and vacuum motor within the handle section.

It is likely that the cleaner unit 1 will be placed in a horizontal orientation while containing cleaning fluid, for example, for cleaning upholstered furniture backs, or will be temporarily stored on a counter or other horizontal surface. Therefore, several features have been incorporated into this unit to protect components against fluid damage.

Firstly, the vacuum motor 8 drives a vacuum blower 8*a* which is provided with a centrifugal separator 37 that has a spirally grooved outer surface and which projects into the plenum chamber 10 of the discharge head section of unit 1. Centrifugal separator 37 rotates with the vacuum blower and acts to separate any fluid that might be entrained within air being drawn in by the vacuum blower of the vacuum motor 8. To further minimize the likelihood of cleaning fluid becoming splashed up into the vacuum blower 8*a*, a separator guard 39, in the form of a splatter screen, may be placed over the centrifugal separator 37.

In order to further insure against cleaning fluid becoming spilled through the vacuum blower 8*a* when the unit 1" is placed in a horizontal orientation, a separator spill guard 41 may be provided in addition to and/or instead of the separator guard screen 39. In a first form of such a spill prevention arrangement, the spill guard 41 is in the form of a simple cylindrical tube that coacts with the volumetric configuration of discharge head section 3 and a visible fill level indicator 43 (FIG. 3) to prevent cleaning solution contained in the receptacle portion 12 (below level indicator 43) from spilling into the vacuum motor intake if the unit is placed in a horizontal or handle-down vertical orientation. The fill level indicator 43 may be in the form of a line or ridge on an interior wall of discharge head section 3 that is visible from the exterior, by either the entirety of section 3 being made of transparent plastic material or by at least the wall portion upon which it is located and/or a corresponding portion of an opposite wall face being made transparent. Of course, any other known type of fill indicator can be utilized, such as a level indicator tube or electrical or mechanical fill level indicator.

Inasmuch as filling of the receptacle portion 12 to the fill level indicator 43 will result in a predetermined quantity of cleaning liquid being situated therein, the diameter and height of the tube forming spill guard 41 can then be set so that when the unit 1, as a whole, is placed on its side or in a handle-down vertical position, the volume available below the open end of the tube forming spill guard 41 will be sufficiently large to contain the predetermined quantity of cleaning fluid plus, possibly, an additional amount capable of compensating for overfilling by the user or splashing of the cleaning liquid. Furthermore, the effectiveness of this feature is aided by providing a sloping surface along which the cleaning fluid will flow radially away from the spill guard 41 as the unit 1 is rotated clockwise from the orientation shown in FIG. 1, and by increasing the diameter of the discharge head section 3 so as to produce a larger volume portion in the vicinity of the spill guard 41 than in receptacle portion 12 below fill line 43, thereby enabling the height of the spill guard 41 to be kept to a minimum.

As an alternative spill prevention arrangement, it is also possible to incorporate a vacuum responsive valve 41*a* (represented schematically in FIG. 1 by broken lines) over the end of the spill guard 41. Such a vacuum responsive valve 41*a* would close the free end of spill guard 41 when the vacuum blower is off, but will open same under action of the vacuum created by the blower during operation. With such an arrangement, it may be possible to dispense with the separator guard 39 and centrifugal separator 37 because it would be unlikely that any significant quantities of cleaning liquid would pass through the vacuum responsive valve. On the other hand, any small quantities of liquid that might be drawn into the blower 8*a* would be atomized thereby and harmlessly dispensed, by the centrifugal force produced by the rotation thereof, outwardly through vents 50 disposed circumferentially thereabout in a manner illustrated in FIGS. 1–3 at the widest portion of the unit. Still further, as an added precaution, the blower 8*a* is sealed-off from the motor and pump.

The pump 22 and the vacuum motor 8 may be powered through control switches 18 and 20 respectively from any conventional electrical power source. Generally these switches would receive power from an external power cord (not shown) which can be plugged into a conventional electrical outlet. It is conceivable that a rechargeable battery power pack of the type used in commercially available hand held vacuum cleaners could be incorporated in the handle section 2 and connected to provide power to the switches 18 and 20. While a separate vacuum motor and pump on-off switch 18, 20, has been shown in FIGS. 1–3, (in which case it may be desirable to provide a switch in the pump operation circuit precluding its operation unless the vacuum motor is on), it is also possible to utilize a single switch that operates both motors to have both the pump and blower driven by a single motor.

Figure 3:
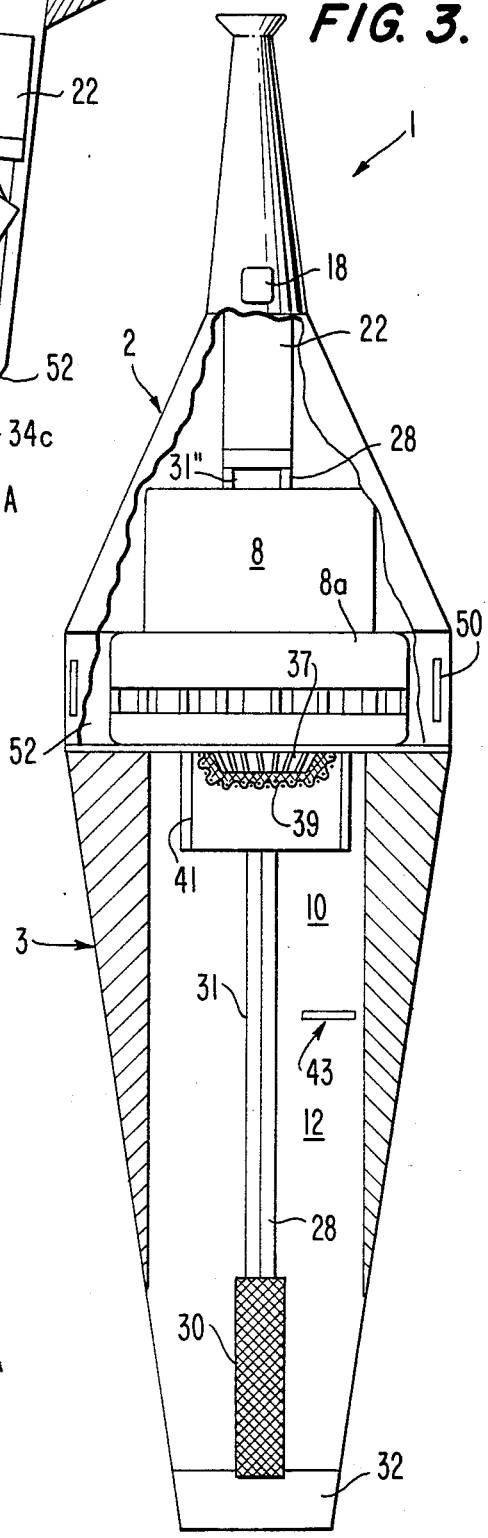
FIG. 3 is a partial sectional view of the hand held extraction cleaner of FIG. 1.

To use the cleaner unit 1 of FIGS. 1–3, the vacuum motor is activated by the switch 20 causing the vacuum blower 8*a* to rotate and create a vacuum in the plenum chamber 10. The normally closed vacuum valve 36 will now open in response to the vacuum in the plenum chamber, and vacuum will be applied via the conduit 24 to the vacuum head 6. Also, if a vacuum responsive valve 41*a* is provided, this valve will be opened immediately by the vacuum created by the blower 8*a* upon activation of the motor 8. The vacuum head 6 may now be placed in proximity to the area to be cleaned, and the switch 20 actuated to cause cleaning solution to be dispensed by the spray nozzle 14. The pump 22 draws this cleaning solution through the filter 30 from the receptacle 12 and up the conduit 28, and then delivers this cleaning fluid under pressure back through the conduit 31 to the spray nozzle 14. By moving the vacuum head 6 across the surface, to be cleaned, the applied cleaning solution is agitated and then is withdrawn, along with any entrained solid material, upwardly through the opening 7 of the vacuum head and past the valve 36 the plenum chamber 10 and the receptacle 12. The centrifugal separator 37 atomizes and disperses any fluid entrained in air which tends to be drawn into the blower 8*a* either directly against the walls of the discharge head section 3 and thus back into the chamber 12, or against the walls of the spill guard 41 and into the chamber 12. The blower is mounted in a blower chamber 52 which seals the blower from the motor 8 and the pump 22.

Figures 4, 5:
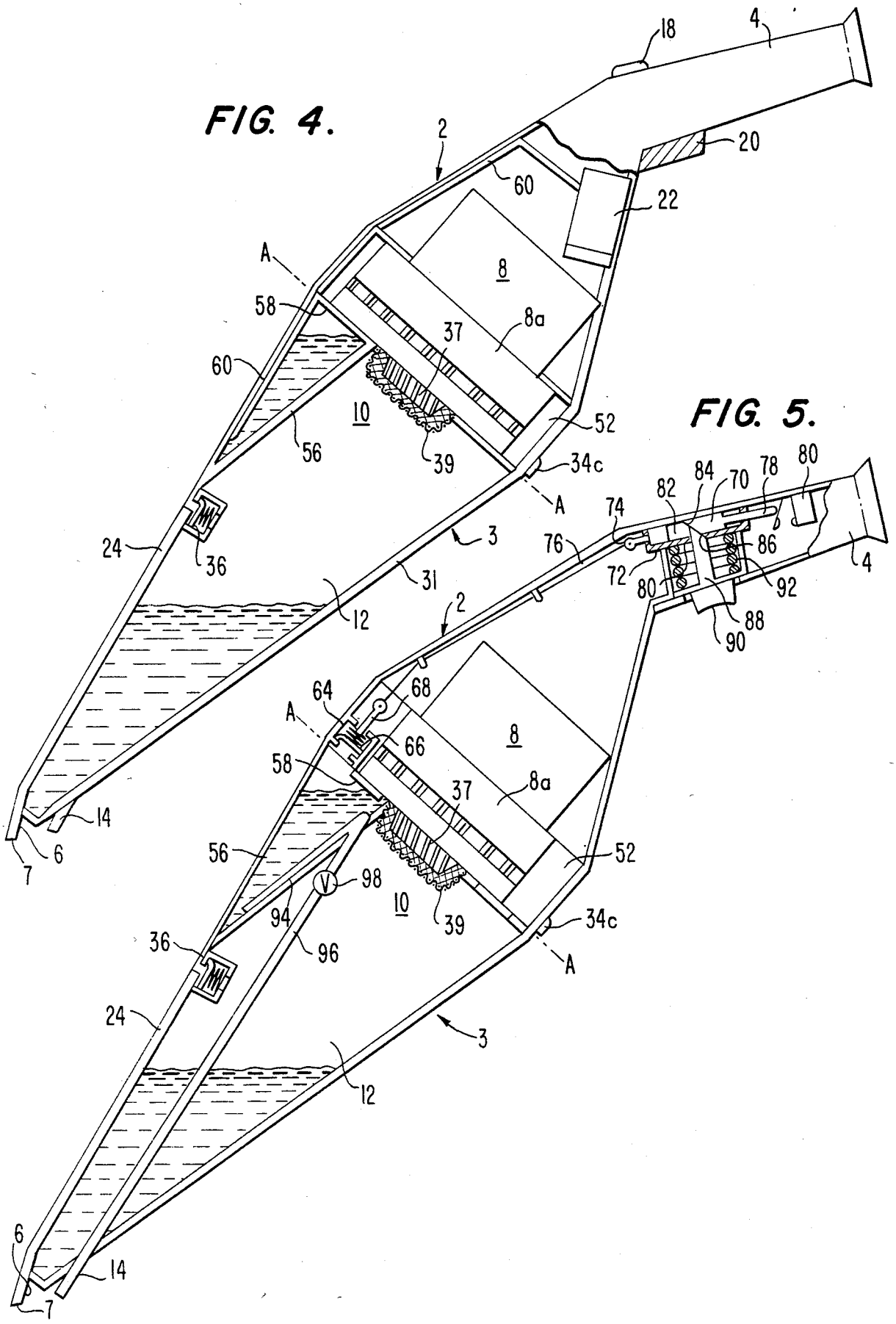
FIG. 4 is a diagrammatic partial longitudinal sectional view of a second embodiment of the hand held extraction cleaner of the present invention.
FIG. 5 is a diagrammatic partial sectional view of a third embodiment of the hand held extraction cleaner of the present invention.

It is apparent that the cleaner device of FIGS. 1–3 is a recirculating cleaner which applies cleaning fluid to a surface and then recovers, filters, and reuses the same cleaning fluid. In some hand-held cleaning units, it may prove desirable to eliminate the filter and the recycling of the cleaning fluid and to employ a dual chamber cleaner which stores dirty cleaning fluid in a first chamber and draws clean fluid from a second chamber. Such a cleaner unit is illustrated in FIG. 4 wherein elements of the cleaner unit which are identical to those shown in FIGS. 1-3 are indicated by like reference numerals. Referring to the cleaner unit 54 of FIG. 4, it will be noted that the cleaning fluid receptacle 12 no longer contains the filter unit 30 of FIGS. 1-3. Instead, the cleaning fluid receptacle is divided into two sections by a wall, which may be formed unitary with the lower discharge head section 3, with the largest section containing the plenum chamber 10, and with a smaller, entirely separate section 56 which is adapted to contain clean, unused cleaning fluid. This cleaning fluid section 56 is open at the top, so that when the lower discharge head section 3 is removed from the upper annular section 2 of the cleaner unit along the lines A—A, the dirty cleaning fluid from the cleaning fluid receptacle 12 may be discharged and clean cleaning fluid can be poured into the cleaning fluid section 56. Suitable gasketing, such as that shown in FIG. 2, is provided to seal the cleaning fluid within the section 56 when the two halves of the cleaner unit 54 are locked together. The open end of the section 56 is closed by a wall 58 of the blower chamber 52 to prevent escape of the cleaning fluid.

To extract cleaning fluid from the chamber 56, the conduit 28 of FIGS. 1-3 is replaced by a conduit 60 which opens at a point spaced slightly above the bottom of the cleaning fluid section 56. Like the conduit 28, the conduit 60 can be molded into the walls of the lower discharge head section 3 and the upper handle section 2 of the cleaner unit. In the upper handle section, the conduit 60 extends to the pump 22.

In the operation of the cleaner unit 54, the vacuum motor 8 is energized by activating the motor switch 20, and then the pump 22 may be energized by activating the pump switch 18. This causes the pump to draw cleaning fluid from the cleaning fluid section 56 through the conduit 60 and to discharge this cleaning fluid under pressure through the conduit 31 and the nozzle 14. The vacuum head 6 operates in a manner identical to that previously described in connection with the cleaner unit 1 of FIGS. 1-3 to draw dirty cleaning fluid through the intake opening 7, the conduit 24, and the valve 36 back into the cleaning fluid receptacle 12. When the cleaning fluid section 56 is empty, the lower discharge head section 3 may be disconnected from the upper handle section 2, and the dirty cleaning fluid may be poured from the cleaning fluid receptacle 12 prior to refilling the section 58 with new cleaning fluid.

FIG. 5 discloses a cleaner unit indicated generally at 62 wherein the pump 22 of the previous embodiments is eliminated and a single unit provides both the vacuum forming and pumping functions for the cleaner. Like the cleaner unit 54 of FIG. 4, the cleaner unit 62 includes a two-chamber lower discharge head section 3 with the cleaning fluid section 56 for fresh cleaning fluid. In this embodiment, however, the end wall 58 of the blower chamber 52 includes a normally closed, spring loaded valve 64. This valve cooperates with the wall 58 to close the open top of the cleaning fluid section 56 when the lower discharge section 3 is locked to the upper handle section 2. However, when the valve 64 is opened, the blower chamber 52 is vented through the valve into the enclosed cleaning fluid section 56. The valve 64 includes a valve head 66 which is connected to an operating valve stem 68. This valve stem may be operated to raise the valve head from the valve seat against the bias of a biasing spring mounted around the valve stem, thereby permitting pressure from the blower chamber to exit into the cleaning fluid section.

Ideally, the blower motor 8 and the valve 64 are operated by a single actuating mechanism, and a number of conventional mechanical linkages may be employed to accomplish this purpose. One such linkage illustrated in FIG. 5 includes an operating slide 70 which reciprocates within a slide chamber 72 secured within the handle 4. At one end, the operating slide extends through an opening in the end of the slide chamber and is formed to provide a connector 74 to which one end of a wire of similar flexible elongated link 76 is secured. The opposite end of the link 76 is secured to the stem 68 for the valve head 66.

A second end of the operating slide 70 extends through an aperture in an opposite end of the slide chamber 72 to form a switch actuator 78. This switch actuator operates to close a normally open switch 80 mounted within the handle 4 when the operating slide 70 is moved to the right in FIG. 5.

To reciprocate the operating slide 70 within the slide chamber 72, the slide chamber is provided with an opening 80 which aligns with an opening 82 extending through the operating slide 70. One wall of the opening 82 is inclined to provide a ramp surface 84 adapted to cooperate with an opposed cam surface 86 formed on the end of a shaft 88 connected to an operating button 90. When the operating button is depressed against the bias of a spring 92, the shaft 88 enters the opening 80 in the slide chamber 72, and the cam surface 86 engages the ramp surface 84 and forces the operating slide 70 to the right in FIG. 5. This causes the switch actuator to close the switch 80 to complete a circuit between a power source (not shown) and the vacuum motor 8 to energize the vacuum motor. At the same time, the link 76 tightens to raise the valve head 66 and vent the blower chamber 52 into the cleaning fluid section 56. Since the blower chamber is not provided with the vents 50 of FIGS. 1-3, it becomes pressurized by the exhaust pressure from the rotating vacuum blower 8*a*, and pressure from this chamber will be applied to the fresh cleaning fluid in the cleaning fluid section 56. Thus the cleaning fluid will be forced under pressure into the open end of an inlet conduit section 94. A pressure relief valve, not shown, may be provided to control the pressure in the blower chamber and exhaust the chamber if the pressure becomes too high.

The open end of the inlet conduit section is spaced a slight distance above the bottom of the cleaning fluid section 56, and it will noted that this inlet conduit section extends along the wall of the cleaning fluid section to a point spaced slightly below the open end thereof, where it joins at a sharp angle with an outlet conduit section 96. The outlet conduit section 96 extends to the nozzle 14, and may constitute a tube which extends through the cleaning fluid receptacle 12, or it may be molded into the side wall of the lower discharge head section 3. Similarly, the inlet conduit section 94 may constitute a separate tubing section, or may be molded into the wall of the cleaning fluid section 56. Normally the sharp angle between the inlet conduit section 94 and the outlet conduit 96 will prevent fluid within the cleaning fluid section 56 from escaping through the nozzle 14 when the cleaner unit 62 is tilted. However, to positively prevent such fluid escape, a normally closed pressure responsive valve 98 may be inserted in either the inlet conduit section 94 or the outlet conduit 96. This valve would be normally closed to prevent fluid spillage, but would open under the pressure of fluid forced into the inlet conduit by pressure from the blower chamber 52.

The dual chamber cleaning units of FIGS. 4 and 5 provide some advantages over the recirculating cleaners of FIGS. 1–3 when vacuuming without cleaning fluid is to be the primary function of the cleaning unit and spot removal is only a secondary function. When the unit is used to vacuum dirt from a surface where large amounts of dirt are present, such as the carpeting in a vehicle, the cleaning fluid in the recirculating cleaning units could possibly become contaminated to such an extent that the filter 30 would clog and cease to function. With the dual chamber cleaning units 54 and 62, the cleaning fluid is not recirculated, and consequently large amounts of dirt can be received in the fluid receptacle 12. This does not impair the ability of these units to provide fresh cleaning fluid at all time from the cleaning fluid section 56. Thus the unit may be effectively employed on a surface, such as a dirty vehicle carpet, to remove large accumulations of dirt and to subsequently, in the same operation, apply cleaning fluid to spot the carpet.

Also, in a dual chamber unit used primarily for vacuuming dirt, the splatter screen separator guard 39 may constitute a conventional dirt and air filter which overlies the opening to the vacuum blower **8*a*. Since fluid recirculation is not required, the centrifugal separator 37** can also be eliminated.

Figure 6:
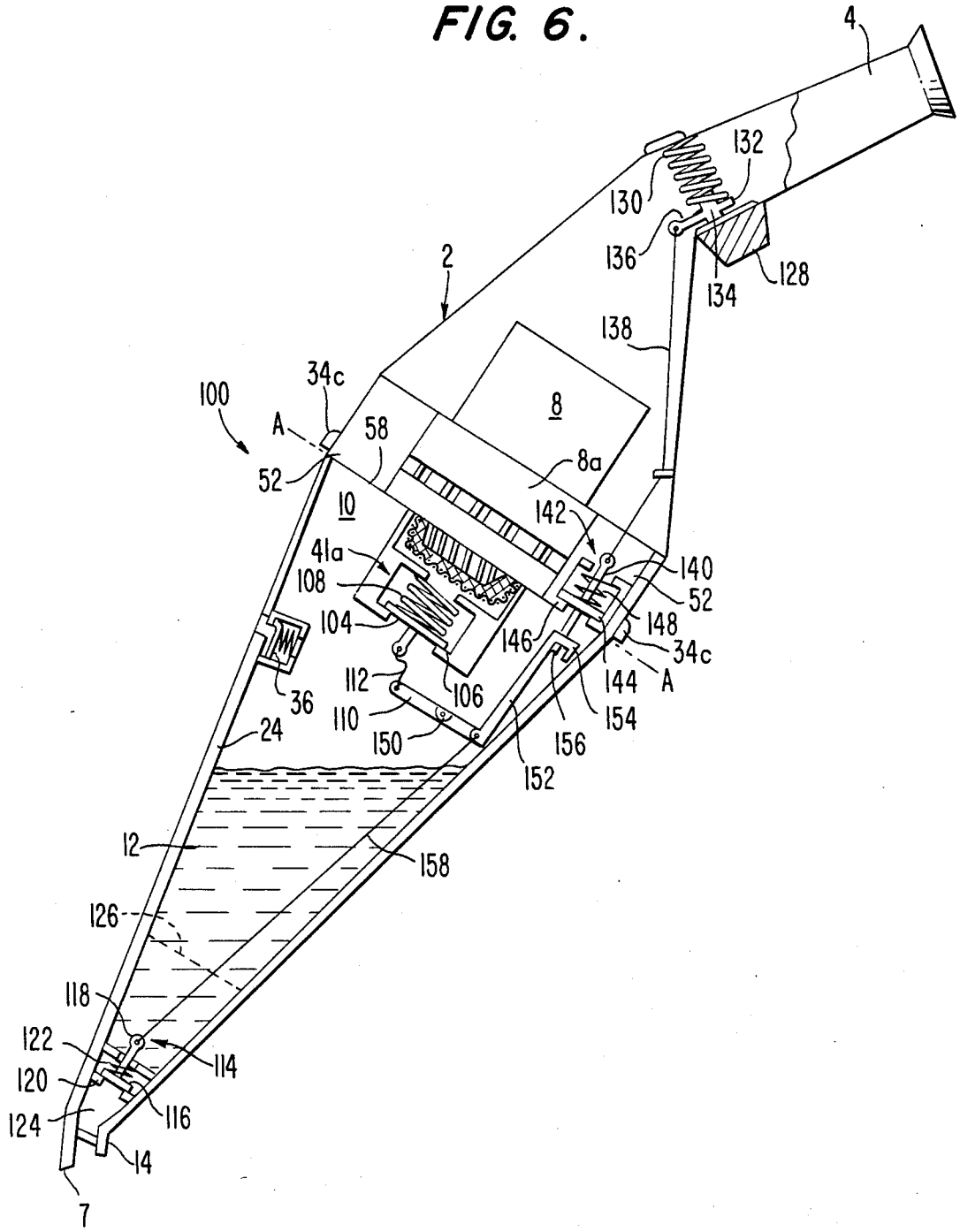
FIG. 6 is a diagrammatic partial sectional view of a fourth embodiment of the hand held extraction cleaner of the present invention.

FIG. 6 illustrates a recirculating cleaner unit 100 which, like the cleaner unit 62, operates without the use of a separate pump for the cleaning fluid. To activate the cleaner unit 100, a switch 102 on the handle 4 is thrown to connect the vacuum motor 8 to a suitable power source. The vacuum blower **8*a* now creates a vacuum which draws a valve element 104 for the vacuum responsive valve 41*a* away from a valve seat 106 against the bias of a spring 108. This permits the vacuum blower to draw a vacuum on the plenum chamber 10 through the vacuum responsive valve. It should be noted that valve element 104 is connected to one end of a pivoted arm 110 by a flexible link 112. There is sufficient slack in the link 112 to permit the valve element to be raised from the valve seat 106** by vacuum from the vacuum blower.

To permit cleaning fluid from the cleaning fluid receptacle 12 to pass out through the nozzle 14, a valve 114 must be opened. This valve includes a normally closed valve element 116 having an operating stem 118 which can be activated to raise the valve element from a seat 120 against the bias of a spring 122. When this occurs, cleaning fluid is permitted to pass through the valve 114 and into a chamber 124. The nozzle 14 opens into the chamber 124 to receive fluid therefrom. Since this is recirculated cleaning fluid, a filter screen 126, which functions in the same manner as the filter 30, is positioned above the valve 114.

To operate the valve 114, an operating button 128 is mounted in the handle 4. This operating button is biased outwardly from the handle by a spring 130 which bears against a flange 132 on a shaft 134, the flange being connected to the operating button. An arm 136 projects from the shaft 134 and is connected to a flexible link 138 which extends to the operating stem 140 for a valve 142. This valve 142 acts in the same manner as did the valve 64 to selectively connect the blower chamber 52 to the discharge head section 3.

When the operating button 128 is depressed, the arm 136 moves toward the center of the handle 4 and tightens the link 138. This causes the operating stem 140, which is connected to a valve element 144, to lift the valve element from a seat 146 against the bias of a spring 148. This permits exhaust pressure which is developed in the blower chamber 58 from the blower **8*a* to pass through the valve 142 to pressurize the plenum chamber 10**.

It is obvious that the plenum chamber 10 cannot be pressurized as long as the valves **41*a* and 36 are open, and consequently it is necessary to positively close the valve 41*a* against the vacuum from the blower 8*a* which tends to hold the valve open. This is accomplished by pivoting the pivoted arm 110 about a pivot 150 to tighten the link 112 and seat the valve element 104. The pivot 150 extends from the sidewall of the discharge head section 3, and mounts the arm 106** for pivotal movement.

The end of the pivoted arm 110 opposite to the end connected to the link 112 is attached to a segment 152 having a hook 154 formed on the free end thereof. This segment extends substantially perpendicular to the pivoted arm 110 and terminates adjacent the upper edge of the discharge head section 3. The hook 154 is removably engaged with a second hook 156 formed to project from the side of the valve element 144 which is opposite to the operating stem 140. When the upper handle section 2 is removed from the lower discharge head section 3, the hook 156 is disengaged from the hook 154. The pivoted arm 110 can be moved to bring the hooks 154 and 156 close to the open end of the discharge head section to facilitate disengagement and reengagement thereof.

A flexible link 158 is connected between the operating stem 118 of the valve 114 and the juncture between the pivoted arm 110 and the segment 152. Thus, when the valve element 144 is raised from the seat 146, the hook 156 draws the segment 152 upward to tighten the link 158 and open the valve 114. Simultaneously, the pivoted arm 110 pivots about the pivot 150 to tighten the link 112 and close the valve **41*a*. This shuts off the vacuum to the plenum chamber 10, causing the valve 36 to close, and the plenum chamber now receives pressure through the valve 142. This pressure forces fluid to pass through the open valve 114 and out through the nozzle 14**.

When the operating button 128 is released, the valve 142 closes permitting the valve 114 to also close. The pivoted arm 110 now pivots to slacken the link 112, and the valve **41*a* will open. The pressure in the plenum chamber 10 will now be pumped out by the blower 8*a* and a vacuum reestablished. The valve 36 will now open so that cleaning fluid will be drawn through the intake opening 7 back into the chamber 12**.

Since the cleaning fluid chamber 12 is located above the inlet to the nozzle 14, it is obvious that the valve 114 could be operated to permit cleaning fluid to pass by gravity through the nozzle 14 without presurizing the plenum chamber 10. For this type of operation, valve 142 can be eliminated and link 138 would be connected to hook 156.

INDUSTRIAL APPLICABILITY

The hand held extraction cleaner of the present invention may be used effectively to clean spots on a surface which may not be easily reached with larger carpet and floor surface cleaners. The unit contains a supply of cleaning fluid which may be selectively sprayed upon a surface and then removed from the surface by the vacuum action of the cleaner. The unit effectively retains liquid in one section thereof and separates the liquid from electrical components contained in a second section of the cleaner. The cleaner may be vertically or horizontally oriented without danger of cleaning fluid spillage or of cleaning fluid reaching the electrical components of the unit.

We claim:

1. A compact, self-contained cleaner and liquid extraction unit of a size and weight for enabling the cleaner to be held, without external support, in one hand of a user and operative for applying fluid to a surface to be cleaned and for picking up fluid and other material by vacuum action, comprising:

a two piece body member formed by a separate handle section and a discharge head section removably connectable at a first end to said handle section, said discharge head section having a closed second end opposite to said first end and having wall means extending between said first and second ends and formed to define fluid chamber means open only at said first end, said fluid chamber means including fluid receiving means and a plenum portion, said plenum portion being adjacent said first end, the fluid chamber means being opened for the discharge of dirty cleaning fluid and the receipt of clean cleaning fluid through said open first end of said discharge head section by the removal of said discharge head section from said handle section, nozzle means mounted at said second end of said discharge head section, means mounted on said discharge head section for providing cleaning fluid from said fluid receiving means to said nozzle means, a vacuum intake head mounted adjacent to said second end of said discharge head section in spaced relationship to said nozzle means, and vacuum conduit means mounted on said discharge head section for connecting said vacuum head to said plenum portion, said handle section including a blower chamber, a lower end connectable to the first end of said discharge head section, an upper end having a handle extending therefrom, and a lower wall means extending across the lower end of said handle section to define one end of said blower chamber, said lower wall means operating to close the open end of said fluid chamber means when said discharge head section is connected to said handle section while providing a vacuum opening between said blower chamber and said plenum portion, vacuum means mounted in said blower chamber and operative through said vacuum opening to create a vacuum in said plenum portion, said vacuum means discharging into said blower chamber to raise the pressure thereof, and means positioned between said blower chamber and said fluid chamber means on said lower wall means within said handle section for selectively placing said blower chamber in fluid communication with said fluid chamber means.

2. The compact, self contained cleaner and liquid extraction unit of claim 1, wherein said vacuum means includes a single unit, said single unit including a vacuum motor and vacuum blower means driven by said vacuum motor, said vacuum blower means operating to form the vacuum in said plenum portion.

3. The compact, self contained cleaner and liquid extraction unit of claim 2, wherein said vacuum blower means operates to provide an exhaust pressure to said blower chamber.

4. The compact, self contained cleaner and liquid extraction unit of claim 3, wherein said means mounted on said discharge head section for providing cleaning fluid from said fluid receiving means includes a valve means mounted between said fluid receiving means and said nozzle means, said valve means being operable to pass fluid from said fluid receiving chamber to said nozzle means.

5. The compact, self contained cleaner and liquid extraction unit of claim 1, wherein said means provided on said lower wall means for connecting said blower chamber to said fluid chamber means includes exhaust valve means, and exhaust valve operating means mounted upon said handle and connected to said exhaust valve means, said exhaust valve operating means being operative to open said exhaust valve to connect said blower chamber to said fluid chamber means or to permit closure of said exhaust valve means to isolate said fluid chamber means from said blower chamber.

6. The compact, self contained cleaner and liquid extraction unit of claim 5, wherein said exhaust valve operating means operates when opening said exhaust valve to terminate the creation of the vacuum in said plenum portion by said vacuum means.

7. The compact, self contained cleaner and liquid extraction unit of claim 1, wherein said plenum portion and said fluid receiving means are formed separately within said fluid chamber means so as to have no communication therebetween, both said plenum portion and said fluid receiving means being open only at the first end of said discharge head section.

8. The compact, self contained cleaner and liquid extraction unit of claim 7, wherein said means provided on said lower wall means for connecting said blower chamber to said fluid chamber means includes valve means positioned to communicate with the open end of said fluid receiving means when said discharge head section is connected to said handle section.

9. The compact, self contained cleaner and liquid-extraction unit of claim 8, wherein said means mounted on said discharge head section for providing cleaning fluid from said fluid receiving means to said nozzle means includes a conduit extending from said fluid receiving means to said nozzle means and a one-way valve means mounted to control fluid flow through said conduit.

10. The compact, self contained cleaner and liquid extraction unit of claim 9, wherein valve operating means are mounted upon said handle and connected to said valve means, said valve operating means being operative to open said valve means to connect said blower chamber to said fluid receiving means or to permit closure of said valve means to isolate said fluid receiving means from said blower chamber.

11. A compact, self-contained cleaner and liquid extraction unit for applying cleaning fluid to a surface to be cleaned and for picking up fluid and other material from said surface by a vacuum action comprising a two piece body member including a unitary handle section and unitary discharge head section removably connected at a first end thereof to a first end of said handle section, said discharge head section including an internal chamber open at only the first end of said discharge head section, said internal chamber having a fluid receiving portion and a plenum portion, a vacuum intake means formed at a second end of said discharge head section which is opposite to said first end thereof, conduit means connecting said vacuum intake means to said plenum portion, nozzle means mounted at said second end of said discharge head section in spaced relation to said vacuum intake means, said nozzle means being operative to apply cleaning fluid to said surface to be cleaned, and means connecting said fluid receiving portion to said nozzle means to supply cleaning fluid to said nozzle means, and vacuum forming means mounted in said handle section, wherein said handle section is provided with a lower wall means at the first end of said handle section and a blower chamber, said vacuum forming means being mounted in said blower chamber and operating to provide an exhaust pressure in said blower chamber, valve means positioned on said lower wall means within said handle section and connected between said blower chamber and the internal chamber of said discharge head section when said discharge head section is mounted upon said handle section to selectively open to place said blower chamber in fluid communication with internal chamber or to close to isolate said internal chamber from said blower chamber, said vacuum forming means being operative to form a vacuum in said plenum portion.

12. The compact self contained cleaner and liquid extraction unit of claim 11, which includes valve operating means mounted upon said handle section and connected to said valve means, said valve operating means being operative to open said valve means and also being operative to actuate a means positioned on said vacuum forming means to terminate the creation of the vacuum in said plenum portion by said vacuum forming means while said valve means is open.

* * * * *